United States Patent [19]

Paxton

[11] 4,189,175

[45] Feb. 19, 1980

[54] DOOR STRIKE

[76] Inventor: Lee C. Paxton, 5050 North Ave., Carmichael, Calif. 95608

[21] Appl. No.: 882,401

[22] Filed: Mar. 1, 1978

[51] Int. Cl.[2] ..... E05B 15/02

[52] U.S. Cl. ..... 292/340; 292/341.18; 292/346

[58] Field of Search ..... 292/340, 341, 341.18, 292/346, DIG. 53; 70/416-418

[56] References Cited

U.S. PATENT DOCUMENTS

| | | | |
|---|---|---|---|
| 2,144,075 | 1/1939 | Mora | 292/341.18 X |
| 2,412,497 | 12/1946 | Edwards | 292/341.18 |
| 2,470,735 | 5/1949 | Young | 292/340 |
| 2,631,881 | 3/1953 | Trachsler | 292/346 |
| 2,937,898 | 5/1960 | Russell | 292/340 |
| 3,290,081 | 12/1966 | Sushan | 292/346 |
| 3,405,962 | 10/1968 | Sushan | 292/346 |
| 3,442,543 | 5/1969 | Weyman | 292/340 |
| 3,592,498 | 7/1971 | Raccuglia, Sr. | 292/346 |
| 4,005,890 | 2/1977 | Murch | 292/346 |

FOREIGN PATENT DOCUMENTS

| | | | |
|---|---|---|---|
| 863789 | 2/1971 | Canada | 292/341.18 |
| 543914 | 6/1922 | France | 292/341.18 |
| 1424827 | 2/1976 | United Kingdom | 292/346 |

*Primary Examiner*—William E. Lyddane
*Attorney, Agent, or Firm*—Blair, Brown & Kreten

[57] ABSTRACT

Disclosed herein is an improved door strike noteworthy in its ability to resist forced entry when disposed upon a door. The structure includes a member adapted to be inserted in the doorjamb and its associated studs having a cylindrical tang for deep insertion therein, a body portion having a hollowed rectanguloid configuration with a tapered curvilinear top surface attached to the tang, and on the side opposite the tang connected to the body portion is a cylindrical disk portion hving a semi-circular step upper portion remote from the tang with a groove and a lip to allow registry with the mating jimmey proof door piece which has an upstanding projection fashioned to fit in the lip and groove of the security device. Also included is an adjustable striker plate to provide flexibility with doors of different thicknesses and the striker plate is attached within the hollow recess of the body portion of the security device with the net effect that the resulting structure will not permit the use of tools or force to pry the door open.

7 Claims, 5 Drawing Figures

FIG.1
PRIOR ART
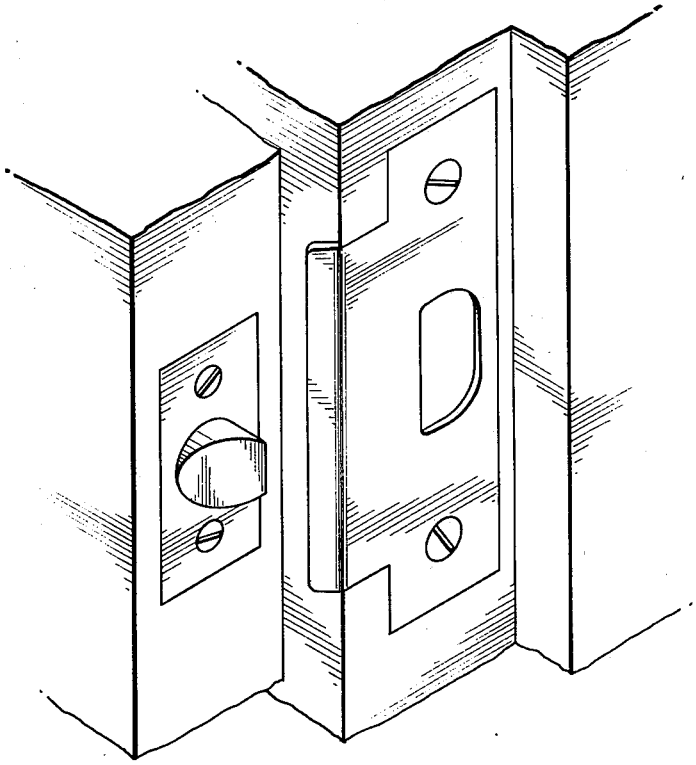
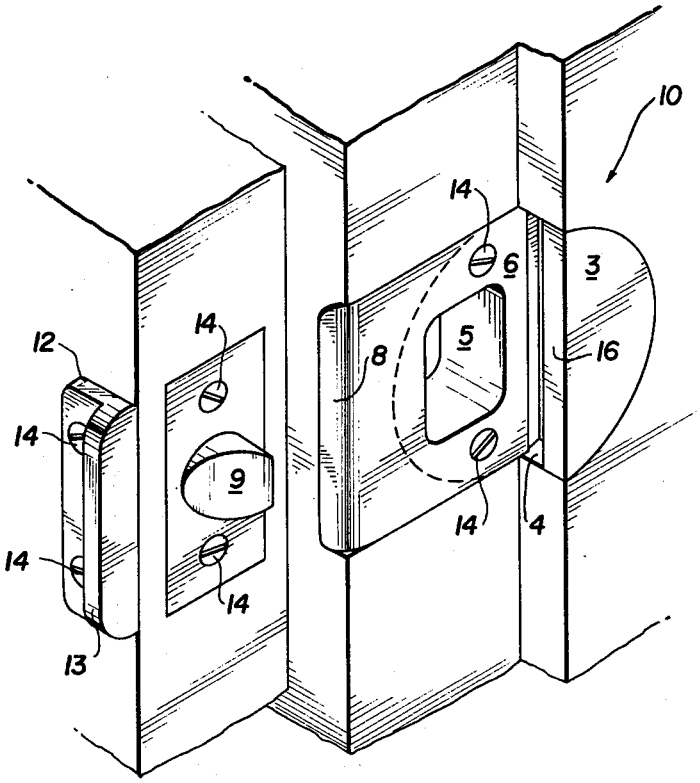
FIG.2

DOOR STRIKE

BACKGROUND OF THE INVENTION

Various types of latching mechanisms for holding doors shut have been shown in the prior art. Those of which that the applicant is aware of include the following U.S. Pat. Nos. 2,631,881 Trachsler, 3,290,081 Sushan, 3,405,962 Sushan, and 3,442,543 Weyman.

While each of the above cited references disclose safety door strikes, none involve the concept of having a tang on the door strike which projects through a drill hole in the door frame studs and consequently do not provide the resistance to having the door pried open as does the present structure. In addition however none of the references show the interlocking door piece disposed on the door in which the lip of the door piece engages a corresponding recessed area or groove to prohibit the use of a crowbar or similar such object to effect unauthorized entry.

SUMMARY OF THE INVENTION

Accordingly, the ensuing description and claims are directed to an improved door strike which resists to a greater degree force and the noise associated with the force to obtain unauthorized entry into a door area. Further this invention contemplates providing a door strike mechanism which is adjustable to accommodate doors of different thicknesses.

These and other features will be made manifest when considering the following detailed specification and drawings.

BRIEF DESCRIPTION OF THE DRAWINGS

FIG. 1 is a depiction of the prior art;

FIG. 2 depicts the apparatus according to the present invention;

DESCRIPTION OF THE PREFERRED EMBODIMENT

Figure 3:
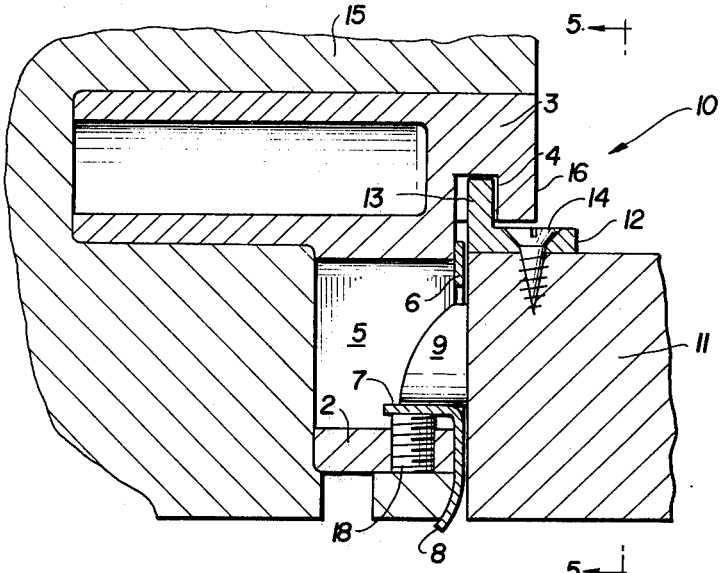
FIG. 3 is a sectional view of the inter-relationship of the door and doorjamb and the locking components.
Figure 4:
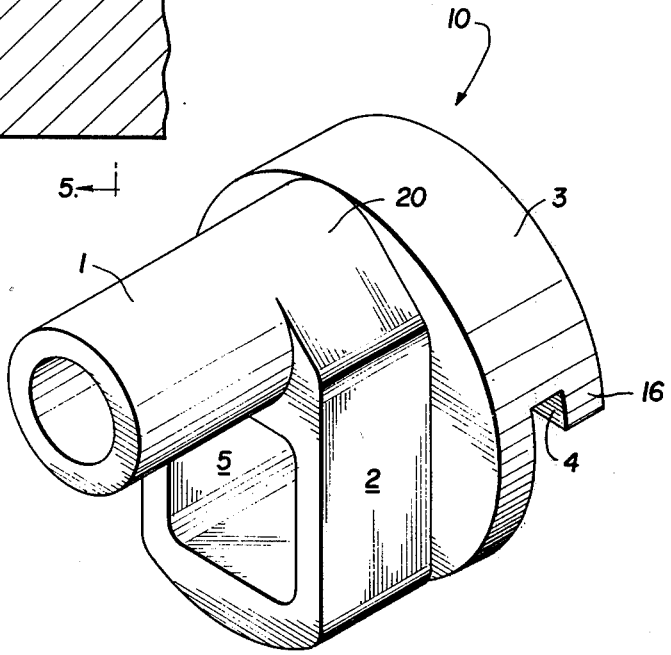
FIG. 4 is a perspective view of the striker element.
Figure 5:
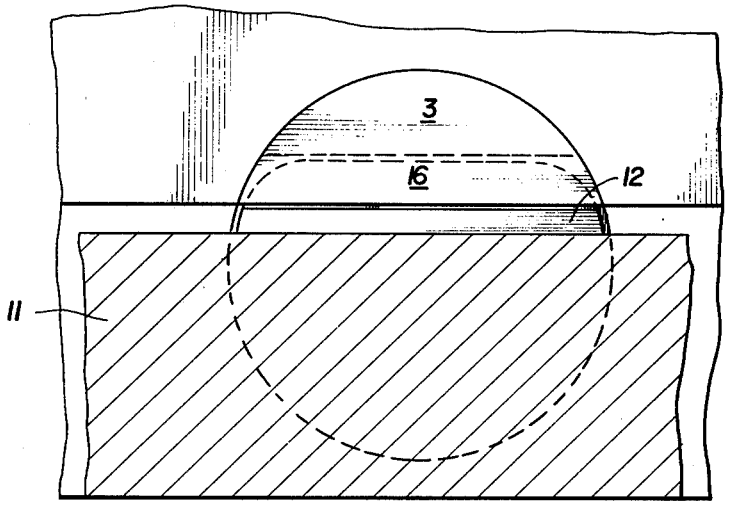
FIG. 5 is a sectional view taken along lines 5—5 of FIG. 3.

Referring to the drawings now wherein like reference numerals refer to like parts throughout the several drawings, reference numeral 10 generally is directed to the structure according to the present invention.

The structure may generally be regarded as having a hollow cylindrical tang portion 1 connected at one extremity of the cylinder with a hollowed rectanguloid having a tapered curvilinear top surface 20 in which the hollowed out area is denoted by reference numeral 5. The body portion 2 is connected on one face opposite from the tang 1 with a cylindrical disk portion 3 having a semi-circular step upper portion remote from the tang with a groove 4 and a lip element 16. The lip element 16 as shown in FIG. 3 is generally in the horizontal plane according to the drawings, but it will be appreciated that the installation would show that this lip is parallel to the face of the door in the vertical plane.

Fastened to this mechanism 10 is a strike plate denoted by reference numerals 6, 7 and 8. This strike plate is connected to the element 10 by means of screws 14 as best seen in FIG. 2 and the strike plate comprises the following components: the strike plate has a planer surface 6 aligned in registry with the groove 4 and a hollowed area to communicate with the hollow section 5 of element 10. FIG. 3 shows an inwardly (relative to the hollowed recess 5) disposed plate segment 7 which nests within the hollowed area and the planer portion 6 extends outwardly to the door to form a curved extremity 8 which arcs away from the door as best seen in FIG. 3. The strike plate can be adjusted in the recess or hollowed out area 5 by means of grub screw 18 so that the inwardly disposed segment 7 is held in registry thereagainst. It is to be noted that with the inclusion of the grub screw 18 various door thicknesses can be accommodated and further the latch element 9 is intended to abut against this inwardly directed segment. FIG. 3 also shows how the structure 10 is inserted into the doorjamb and studs as generally indicated by reference numeral 15.

The door 11 has disposed thereon a conventional striker element 9 fastened to the door 11 by means of screws 14. However, the door is also provided with a mating jimmey proof door piece which is generally defined as an L-shaped section shown in FIG. 3 that is screwed onto the door. The base of the L-shaped jimmey proof piece denoted by reference numeral 10 is inserted and screwed onto the door by screws 14 and the upstanding leg of the piece 13 is oriented to fit flush with the end of the door 11 (the area from which striker 9 extends) and the upstanding portion or leg 13 is received in groove 4 of the cylindrical disk portion 3 of the tang assembly.

In operation therefore it will be seen that from FIG. 3 when the door is in the closed position that the upstanding vertical leg 13 nests within the groove 4 of the disk portion 3 and the striker 9 tangentially engages the inwardly directed portion 7 of the striker plate within the recessed hollow 5. The L-shaped piece 12 and 13 in conjunction with the groove and lip 4 and 16 stop and severely limit the amount of exposure that one would need to pry the door open and further the substantive depth of the tang 1 within the stud and doorjamb 15 and its offset relative to the body provides additional leverage and retention so that the entire assembly is difficult to dislodge by force. The offset relative to the body increases the likelihood that the tang will enter the center of the stud and not the edge. In addition however the striker's abuttment against element 7 and its support by grub screw 18 within the central body portion 2 of the hollow rectanguloid provides a support which deters forced entry.

Having thus described the invention it will be apparent that numerous structural modifications are contemplated as being a part of this invention as set forth in the above specification and as defined in the claims.

What is claimed is:

1. An improved door strike assembly to be inserted within a door, a door jamb, and a wall stud proximate to the jamb, the combination comprising:

a cylindrical tang which extends through the jamb and into the stud, a body portion integral with said tang extending from one end of said cylindrical tang having a hollowed rectanguloid configuration and a curvilinear top surface which has a side which is hollowed, a cylindrical disk portion integral with said body portion disposed on a side remote from said tang having a semi-circular stepped upper portion linearly remote from the tang and provided with a lip and a groove and a hollowed lower portion communicating with the hollowed body portion so that a striker on the door is allowed to register with the hollowed portions and said lip serves as an abutment against the door and whereby said tang's disposition into the stud deters the door from being forced open as by the sudden load applied by a swift kick.

2. The device of claim 1 in which a striker plate overlies said hollowed portions and said striker plate includes a face plate parallel and flush with a planer surface on said lower portion of said cylindrical disk and said strike plate includes a first portion extending into the hollowed areas and a curved outer portion that wraps around an edge of the jamb.

3. The device of claim 2 in which said door has mounted thereon a mating jimmey proof door piece comprising an L-shaped element with a, base which is fastened to said door on its outer face and an upstanding vertical element.

4. The device of claim 3 in which said upstanding vertical element nests with the groove disposed on said semi-circular stepped upper portion.

5. The device of claim 4 in which said first portion of the striker plate which extends within the hollowed areas and rests against the door striker is adjustable to accommodate doors of different widths.

6. The device of claim 5 in which the adjustable striker plate is adjusted by means of a grub screw which extends through a bottom face of said disk portion.

7. The device of claim 6 in which the tang enters the stud substantially at its center to provide greater strength.

* * * * *